US005494474A

United States Patent [19]

Vernon

[11] Patent Number: 5,494,474

[45] Date of Patent: Feb. 27, 1996

[54] LENS BLOCKING AND CONSTANT CENTER THICKNESS SYSTEM

[75] Inventor: Edward W. Vernon, Santa Barbara, Calif.

[73] Assignee: D.A.C., Inc., Carpinteria, Calif.

[21] Appl. No.: 141,850

[22] Filed: Oct. 21, 1993

Related U.S. Application Data

[63] Continuation-in-part of Ser. No. 676,762, Mar. 27, 1991, Pat. No. 5,205,076, and a continuation-in-part of Ser. No. 966,140, Oct. 26, 1992, abandoned.

[51] Int. Cl.[6] ..... B24B 13/005

[52] U.S. Cl. ..... 451/364; 451/390

[58] Field of Search ..... 451/364, 390, 451/254, 255, 256, 277, 240, 146, 42, 43

[56] References Cited

U.S. PATENT DOCUMENTS

| | | | |
|---|---|---|---|
| 4,239,712 | 12/1980 | Neefe | 51/284 R |
| 4,619,082 | 10/1986 | Dent et al. | 451/390 |
| 4,653,234 | 3/1987 | Lombard | 451/390 |
| 4,856,234 | 8/1989 | Goins | 451/390 |
| 5,291,692 | 3/1994 | Takahashi et al. | 451/390 |

*Primary Examiner*—Maurina T. Rachuba

[57] ABSTRACT

A blocking system for supporting a lens blank having a first cut, posterior surface for a contact lens or an intraocular lens and a reference surface includes a block having a forward extension with a cylindrical side wall and front surface complementary to the posterior surface of the lens blank. A disposable, annular collar of synthetic resin surrounds the cylindrical extension. The top edge of the collar abuts the reference surface of the lens blank and serves to determine the location of the posterior surface during cutting the front surface of the lens. The shaped and/or the cylindrical extension may be separable from the blocking member such as a plastic cap having a shank frictionally received in a cavity in the front surface of the blocking member or a plastic cap adhered to the end of the cylindrical extension.

11 Claims, 2 Drawing Sheets

LENS BLOCKING AND CONSTANT CENTER THICKNESS SYSTEM

CROSS REFERENCE TO RELATED APPLICATION

This application is a continuation-in-part of our U.S. application Ser. No. 07/676,762, filed Mar. 27, 1991, now U.S. Pat. No. 5,205,076, issued Apr. 27, 1993, and U.S. application Ser. No. 07/966,140, filed Oct. 26, 1992 now abandoned.

BACKGROUND OF THE INVENTION

Our prior applications disclose manufacture of contact and intraocular lenses by forming reference surfaces in a lens blank along with the posterior surface for the lens. The partially formed lens blank is then mounted to a blocking member which has complementary surfaces that mate with the reference surface and automatically align the lens blank. The blocking member has a flange that abuts against a spindle or collet in which the member is held during formation of the outer lens surface. The known distance between the abutting surface of this flange and the reference surface on the lens blank allows the front surface of the lens to be formed without having to separately measure the thickness of the lens blank, or enter dimensional information into the computer which controls the operation. A recessed collet within the spindle enables the blocking member flange to directly abut the end of the spindle.

The blocking member for forming the front surface curve was preferably formed of plastic in order to preserve tool life of the diamond cutting tool. The reference ledges were cut away during cutting of the front surface of the lens. It was suggested that the front surface of the blocking member could be reshaped and reused after the front surface of the lens was cut and the annular cylindrical ledges were cut away. The blocking member was manufactured in a two part mold.

The axis of the front curved surface was not reliably concentric with the outer axis of the blocking member. One proposal is to produce a short front curve blocking member having a length which is less than ½ of the outer diameter of the member. However, the short blocking member does not have a mounting shank and must be grasped in the collet of a spindle. Slight variations in the external diameter can affect the position of the block in the collet and can cause variations among lenses produced in a blocking member even if the base curves of the blanks have a constant center thickness. The short blocking member is usually made of plastic. Again, the force of the collet grasping the block can distort its shape and cause variations in the position of the reference ledge and the shape of the surface complementary to the base curve.

Different lenses require different posterior surfaces. This requires manufacture and inventory of blocking front curve members having a range of curves. In the case of contact lenses, base curves with radii of 7, 8 and 9 mm are usually required. This increases the complexity of molding the blocking members, requires an inventory of many small parts and can lead to human error in selection of the correct blocking member.

Moreover, the front curved, convex surface of the molded plastic blocking member can also have variations from shrinkage of the resin during cure and from imperfections in the surface of the mold cavity. If the front surface blocking member has a metal surface, it can be polished to a much more perfect finish and is hard and does not deflect. However, as discussed above, the need to cut the ledge surrounding the curved surface of the blocking member makes the use of a metal block impractical for supporting the base curve while cutting the front curve.

STATEMENT OF THE INVENTION

An improved blocking member for use during cutting the front surface of a lens is provided in accordance with the invention. The improved blocking member supports the posterior surface on a mandrel having a complementary surface while supporting the reference and locating surface on a softer, disposable member. The posterior surface mandrel can be reutilized many times to support lens blanks by replacing the disposable, reference surface support member.

The improved blocking member can have a central flange with a rearward facing surface that is spaced a precisely known distance form its forward alignment surface. The blocking member includes a rearward directed shank that is sized to be held by a collet, preferably recessed within a spindle such that the rearward surface abuts the front end of the nose of the spindle.

A forward extension is coaxially disposed on the front surface of the flange. The extension has a side wall sized to receive the disposable member and has a front surface having a shape complementary to that of the posterior curve of the lens blank. The side wall is preferably cylindrical and the disposable member takes the form of an annular, cylindrical ring that snugly fits the side wall of the extension. The disposable member has an upper surface that abuts the reference surface of the lens blank when the posterior curve is seated on the complementary curved surface of the blocking member. The ring surrounding the extension forms a cavity for supporting the first cut posterior surface of the lens blank. The curved surface of the extension can be coated with an adhesive such as a conventional water soluble wax before placing it in contact with the posterior surface of the lens blank.

The block-lens blank assembly is secured to the collet in a lathe. During cutting of the front curved surface of the lens, the upper portion of the cylindrical ring is cut away. The lens is removed for further processing. The remainder of the cylindrical ring is removed from the side wall of the extension and the wax is washed from the curved surface of the block. A cylindrical ring is placed on the side wall and the curved surface of the extension is again coated with adhesive. The assembly is ready to receive another lens blank for cutting the front surface.

A batch of lenses with the same posterior surface can be cut in series by this procedure. The block can be replaced with a block having a different shaped surface on the face of the extension when lenses having a different posterior surface such as a base curve are to be lathed.

Another aspect of the invention relates to a block having a separable cylindrical extension. The front surface of the block can include a cavity. The separable extension can be a cap which is adhered to the top of the cylindrical extension or a cylindrical extension with curved surface can be formed with a rearward shank which locks in the cavity during lathing and can be removed after a batch of lenses are formed. The forward portion of the extension above the front surface of the flange has a cylindrical rim which receives an annular cylindrical ring.

The separable mandrels are formed of highly polished metal or plastic and are precut to have different curves that are complementary to the base curves needed to form contact or intraocular lenses. The mandrels are preferably formed of synthetic resins, usually an acrylic such as polymethylmethacrylate.

These and many other features and attendant advantages of the invention will become apparent as the invention becomes better understood by reference to the following detailed description when considered in conjunction with the accompanying drawings.

DETAILED DESCRIPTION OF THE INVENTION

Figure 1:
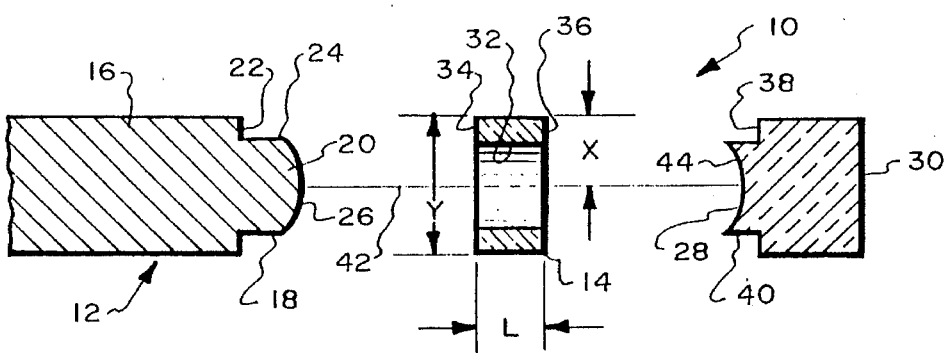
FIG. 1 is an exploded view in section of the assembly of block, separate ring collar and lens blank precut with base curve and reference surface in accordance with the Invention.

Referring now to FIG. 1 the front curve lens blocking system 10 of the invention includes a blocking member 12 and a ring collar 14. The blocking member 12 has a rear shank 16 adapted to be received in a collet of a spindle, not shown, and a front surface 18. The front surface 18 includes an extension 20 which is surrounded by an annular ledge 22. The extension 20 has a side wall 24 and a shaped, front surface 26, complementary to the posterior curved surface 28 on the lens blank 30.

The extension 20 is usually cylindrical and the ring collar 14 has an inner surface 32 adapted to be snugly received on the side wall 24 of the extension. The collar has a rear edge 34 which is complementary to and is adapted to seat on the ledge 22. The front edge 36 of the collar 14 is complementary to and adapted to seat on the reference surface 38 of the lens blank 30. The inner surface 32 of the collar 14 is also adapted to snugly receive the surface 40 adjacent to and normal to the reference surface 38. The length of the collar is chosen such that the distance Y between the front edge 36 of the collar 14 and the center point 42 of the shaped front surface 26 of the cylindrical extension 20 is the same as the distance X between the reference ledge 38 of the lens blank 30 and the center 44 of the base curved surface 28 of the lens blank. The length L of the ring may be slightly longer than this distance to accommodate for a layer of adhesive such as a water soluble wax conventionally used during cutting lenses.

Figure 2:
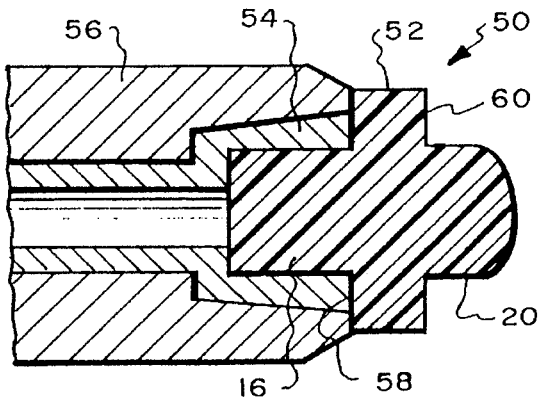
FIG. 2 is a view in section of a further embodiment of a front curve block shown held in a collet of a spindle.

The shank 16 of the blocking number 12 has no stop structure to provide a reference location for the front surface and ledge 22. The blocking number 50 shown in FIG. 2 has a flange 52 intermediate the shank 16 and cylindrical extension 20. The flange is wide enough to be received in the collet 54 of a standard draw back spindle 56 of a lathe, not shown. The rear surface 58 of the flange is normal to the axis of the block 50 and is parallel to the front surface 60 of the flange. The front surface 60 of the flange 52 may be the same as the front surface which contains the cylindrical extension 20. The flange may be wide enough to provide an annular probing surface 60 surrounding the outside of the ring collar 14 when it is in place on the cylindrical extension 20.

Figure 3:
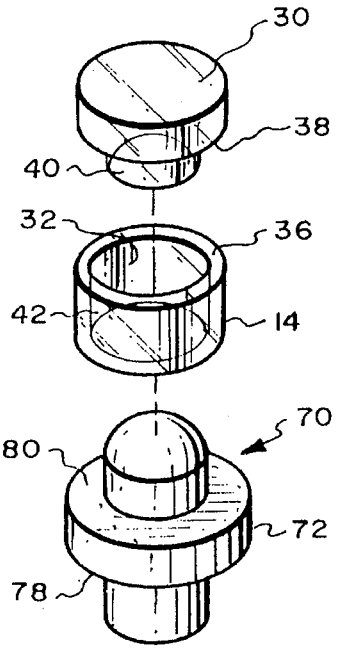
FIG. 3 is is an exploded view in perspective of a preferred embodiment of a front curve blocking system.
Figure 4:
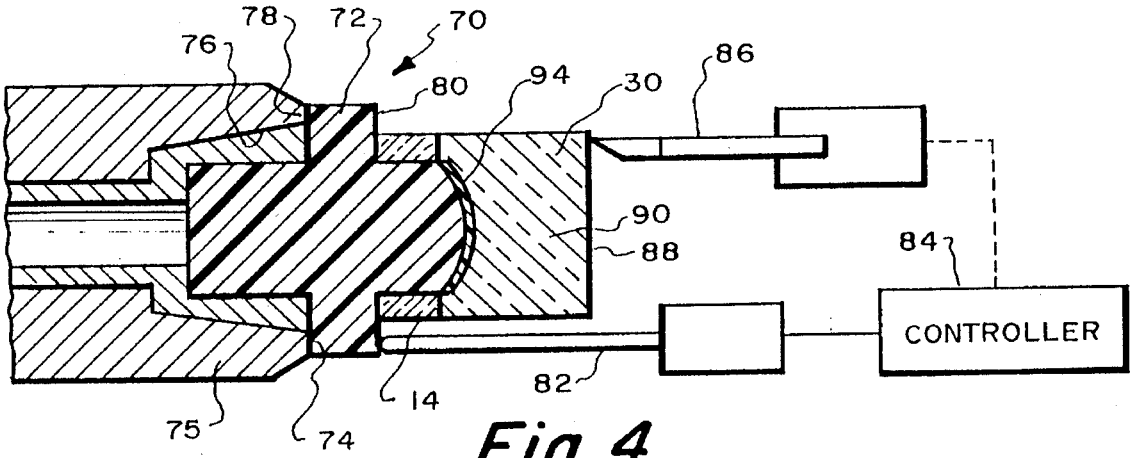
FIG. 4 is a view in section of the front curve blocking system assembled with a lens blank with precut base curve and reference surface shown held in the recessed collet of a dead length spindle.

A more preferred configuration of a blocking member 70 is shown in FIGS. 3–4. The blocking member 70 has a flange 72 wide enough to abut the nose end 74 of a dead length spindle 75 having a recessed collet 76. The rear 78 and front 80 surfaces of the flange 72 are both normal to the axis of the blocking member 70 and are parallel to each other and to the outer reference edge 36 of the collar 14. Therefore, the depth of the center 42 of the base curve is located when the edge 36 of the collar 14 abuts the reference ledge 38 of the lens blank. A series of lenses 90 can be cut with the same base curve after a single probe of the front surface of the flange 72 by means of a probe 82.

Figure 7:
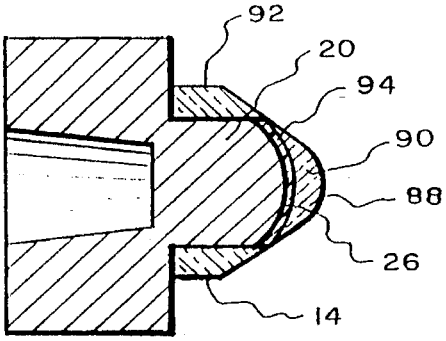
FIG. 7 is a view in section of a finished lens shown on the front curve blocking system of FIG. 5.

The probe 82 sends a signal to a controller 84 which controls the cutting path of the cutting tool 86 relative to the front surface 88 of the blocked lens blank 30 to form a final lens 90 as shown in FIG. 7. The cutting of the front surface 88 results in cutting off the top portion of the collar 14. The lens 90 is removed from the shaped front surface 26 of the cylindrical extension 20 and the remainder 92 of the collar 14 is removed from the extension 20. The wax coating 94 is washed off the surfaces of the cylindrical extension 20. A collar 14 is installed on the extension 20 and a fresh coating 94 of adhesive wax is applied to the shaped complementary surface 26 of the cylindrical extension. The blocking system is ready to receive a base curve 28 of a lens blank 30 for cutting another lens.

Figure 5:
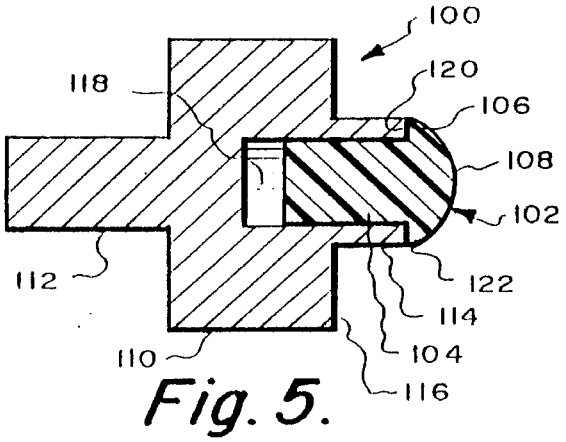
FIG. 5 is a view in section of a front curve blocking system according to the invention with a replaceable extension with a surface complementary to the base curve surface of a lens button.

As previously discussed, contact lenses are generally manufactured with several different base curves such as with 7 mm, 8 mm and 9 mm radii. This requires preparation of a front curve. Furthermore, all metal blocking members conduct heat rapidly away from the wax adhesive which may set before the base curve of the blank is adhered to the block. A further embodiment of the front curve blocking member 100 is shown in FIG. 5. The blocking member 100 has a replaceable cap 102. The cap 102 has a shank 104 connected to a convex portion 106 having an outer shaped surface 108 complementary to one of the base curves to be blocked.

The blocking member 100 comprises of a central flange 110 having a rear shank 112 for receipt in a collet of a lathe. An annular rim member 114 extends outward from the front surface 116 of the flange 110. The rim connects to a cavity 118 which frictionally received the shank 104 of the cap 102. The rear of convex portion 106 of the cap 102 extends past the shank 104 forming a skirt 120, which seats the cap 102 on the top edge 122 of the rim 114.

The cap is preferably formed of a synthetic resin since synthetic resins are good thermal insulators and will not conduct heat away from the wax layer. The caps can be readily manufactured in large quantities at low cost with high precision. The caps need not be reused. They can be disposed of after cutting a single lens.

Figure 6:
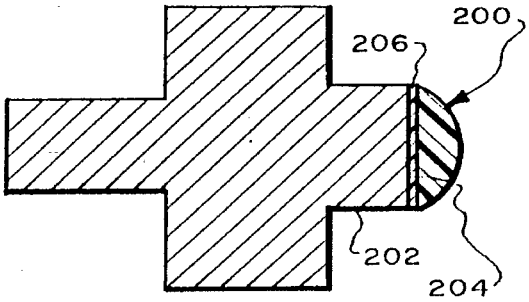
FIG. 6 is a view in section of an alternate embodiment of a front curve block with replaceable front surface.

The replaceable cap 200 need only comprise the curved portion of the cylindrical extension 202 as shown in FIG. 6. The replaceable cap 200 can be adhered to the top surface 204 of the cylindrical extension 202 by means of a layer 206 of adhesive such as wax or a more adherent adhesive such as a thermoplastic adhesive tape or double-sided adhesive tape. A collar, not shown, is received over the cylindrical extension 202. The cap 200 is also preferably formed of a resin such as polymethyl-methacrylate.

It is to be realized that only preferred embodiments of the invention have been described and that numerous substitutions, modifications and alterations are permissible without departing from the spirit and scope of the invention as defined in the following claims.

I claim:

1. A blocking system for mounting a lens blank in which a posterior surface of a contact or intraocular lens and an annular reference surface at a known depth in the blank have been formed, said annular reference surface surrounding said posterior surface, said system including:

a blocking member including a central portion having a forward surface and a rearward surface;

a forward extension axially located on said forward surface, said forward extension having a width smaller than the forward surface, having a side wall and a shaped end complementary to said posterior surface whereby an annular portion of the forward surface surrounds said extension;

a rearward extending shank connected to said rearward surface for being received in a spindle of a lathe, said central portion, forward extension and rearward extension being connected into a single rigid assembly; and a separate, annular member formed of a synthetic resin, said annular member having a first end wall and a second end wall, said member being snugly fitted on said side wall of the forward extension with the first end wall being seated on the annular portion of the forward surface of the central portion and the second end wall extending forward of the side wall of the forward extension, being complementary to and seating on said reference surface of the blank.

2. A blocking member according to claim 1 in which the side wall of central portion of the forward extension forms a cylinder.

3. A blocking member according to claim 2 in which the reference surface is flat and is perpendicular to the axis of the central portion.

4. A blocking member according to claim 1 in which the central portion has a width larger than the shank and the sidewall, forming a flange having a rear surface and a front surface.

5. A blocking member according to claim 4 in which the flange has a width sufficient that the rear surface abuts the nose of a spindle.

6. A blocking member according to claim 1 in which the blocking member is formed of metal.

7. A blocking system according to claim 1 in which the shaped end of the forward extension is separable from the central portion and further including means for releasably securing the shaped end of the forward extension to the central portion.

8. A blocking system according to claim, 7 in which the central portion includes a cavity, said forward extension includes a rearward extending shank and said shank is received in said cavity.

9. A blocking system according to claim 7 in which the shaped end is separable from the cylindrical extension.

10. A blocking system according to claim 7 in which a plurality of separable forward extensions are provided each having a shaped end complementary to a different posterior surface.

11. A blocking member for mounting a lens blank in which a posterior surface a contact lens or intraocular lens and an annular reference surface at a known depth surrounding said posterior surface have been formed including:

a central portion having a forward surface and a rearward surface;

a spindle engaging member rigidly connected to and extending rearward from said central portion;

a lens blank support member having a front curved surface complementary to and axially located on said posterior surface, extending forward from and separable from said forward surface;

means for securing said lens blank support member to said forward surface during shaping of the front surface of the lens blank including a cavity formed in said forward surface and shaft means connected to the rear of the lens blank support member, a second end received in said cavity, said shaft means including means for fixedly securing said shaft in said cavity; and said shaft means including a cylindrical side wall between said front curved surface and the forward surface of the central portion having a diameter smaller than the forward surface whereby an annular portion of the forward surface surrounds said cylindrical side wall and further including a cylindrical ring formed of synthetic resin, having a first end wall and a second end wall, said ring being snugly received on said side wall with the first end wall being seated on the annular portion of the forward surface of the central portion and the second end wall, said side wall having a height less than said ring And said second end wall, said side wall and curved surface of the lens blank support member forming a cavity for receiving the posterior surface of the lens blank and said second end wall in complementary to and engaging said annular reference surface of the lens blank when said blank is mounted on said blocking member.

* * * * *